United States Patent [19]

Fike

[11] 4,007,701

[45] Feb. 15, 1977

[54] MARINE VESSEL SCRUBBING DEVICE

[76] Inventor: Don G. Fike, 16 Town & Campus Apt., Fulton, Mo. 65251

[22] Filed: Nov. 11, 1975

[21] Appl. No.: 630,807

[52] U.S. Cl. ..... 114/222; 15/53 AB

[51] Int. Cl.[2] ..... B63B 59/00

[58] Field of Search ..... 114/222; 15/53 A, 53 AB, 15/DIG. 2

[56] References Cited

UNITED STATES PATENTS

| | | | |
|---|---|---|---|
| 2,257,255 | 9/1941 | Yingling | 15/53 AB |
| 3,000,025 | 9/1961 | Emanuel | 15/53 AB |
| 3,561,391 | 2/1971 | Locati | 114/222 |
| 3,752,109 | 10/1971 | Seiple | 114/222 |

*Primary Examiner*—Trygve M. Blix
*Assistant Examiner*—Sherman D. Basinger
*Attorney, Agent, or Firm*—Polster and Polster

[57] ABSTRACT

In a marine vessel bottom cleaning device wherein a floating platform has spaced ways between which a vessel to be cleaned passes lengthwise and scrubbing devices are supported on the platform, at least two, elongate scrubbing devices, spaced from one another lengthwise of the ways, extending in a direction generally athwart the ways and toward one another, and in at least one position overlapping one another across the lengthwise path of the vessel, the scrubbing devices being selectively movable relative to one another from the position at which they overlap one another along the lengthwise path of the vessel in a direction outboard of the vessel and away from one another. The entire scrubbing device can be raised and lowered with respect to the platform.

5 Claims, 4 Drawing Figures

MARINE VESSEL SCRUBBING DEVICE

BACKGROUND OF THE INVENTION

The problems of cleaning marine growth from vessels, and the general type of hull scrubbing device to which the present invention is directed, are illustrated and described in U.S. Pat. Nos. to Campbell, 3,227,124 and Locati, 3,561,391. The Campbell and Locati devices are effective for small craft, but their practical utility is limited to vessels having an 8 to 12 foot beam.

Devices intended for use to clean larger craft are frequently quite elaborate, such, for example as the devices of Romano et al, U.S. Pat. No. 3,859,948, Seiple, U.S. Pat. No. 3,752,109, McLane, U.S. Pat. No. 630,260, Laney, U.S. Pat. No. 3,709,184, and Holland, U.S. Pat. No. 593,298.

One of the objects of this invention is to provide a boat bottom scrubbing device which is simple, but capable of accommodating larger vessels than the device of the Campbell patent, and small vessels as well.

Other objects will become apparent to those skilled in the art in the light of the following description and accompanying drawings.

SUMMARY OF THE INVENTION

In accordance with this invention, generally stated, in a marine vessel bottom cleaning device wherein a floating platform has spaced ways between which a vessel to be cleaned passes lengthwise thereof, and scrubbing means are supported on the platform, at least two elongate scrubbing means are provided spaced from one another lengthwise of the ways, extending in a direction generally athwart the ways and toward one another and in at least one position overlapping one another along the lengthwise path of the vessel, and means are provided for moving the scrubbing means relative to one another from the position at which they overlap one another along the lengthwise path of the vessel in a direction outboard of the vessel and away from one another. In the preferred embodiment, means are provided for translating the entire scrubbing means heightwise of the platform, to accommodate vessels of different draft and also to permit scrubbing of a large area in two passes of the vessel. In the illustrative embodiment described, the means for accomplishing the translation of the scrubbing means toward and away from one another and for the elevation of the scrubbing means include an outside frame, an inside frame which is mounted to move up and down within the outside frame, and a brush support movable transversely on the inside frame.

DESCRIPTION OF THE PREFERRED EMBODIMENT

Figure 1:
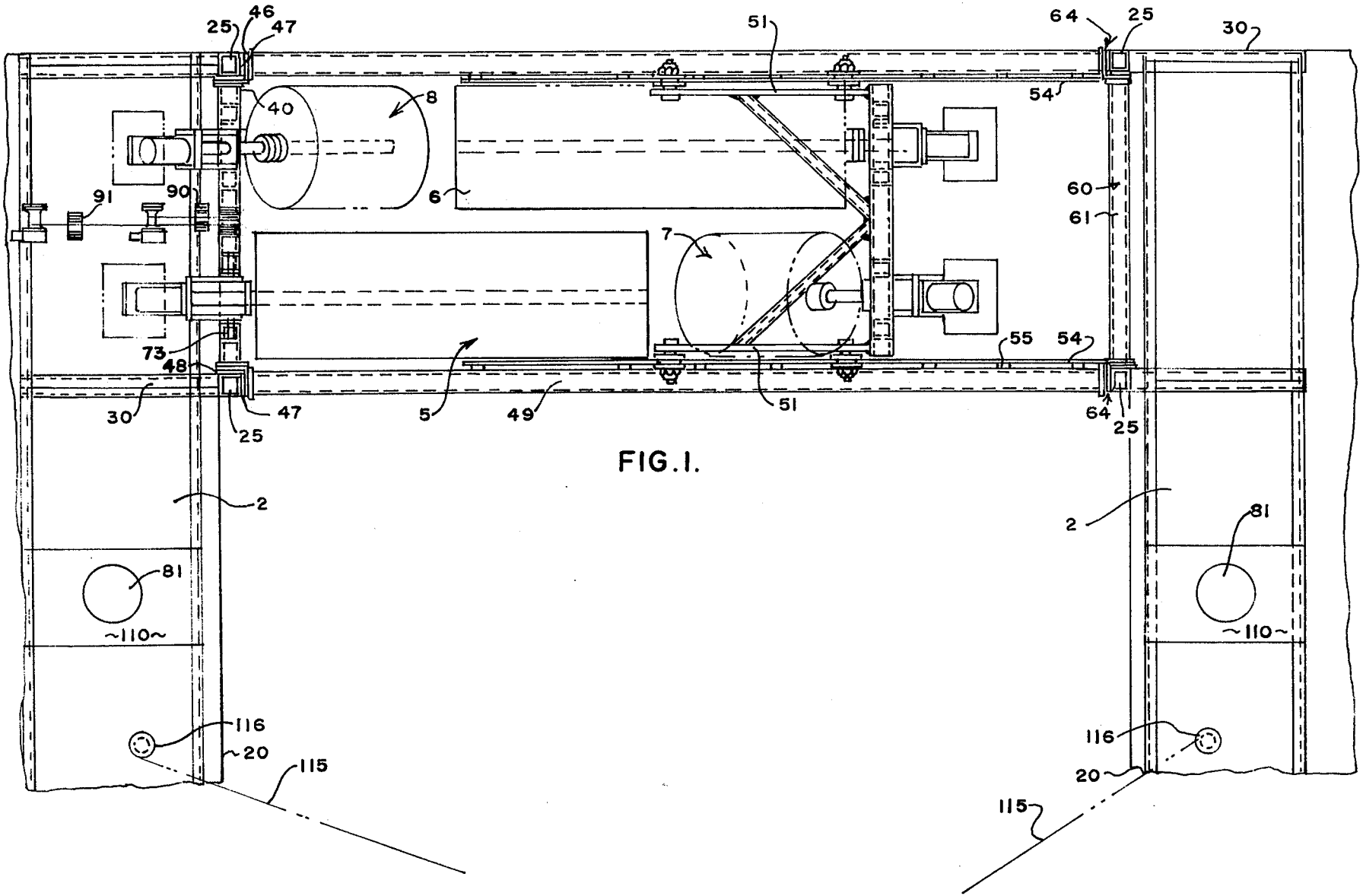
FIG. 1 is a top plan view of one illustrative embodiment of vessel scrubbing device of this invention.

Referring now to the drawings for one illustrative embodiment of marine vessel bottom cleaning device of this invention, reference numeral 1 indicates a platform, which includes ways 2, an outside frame 3, an inside frame assembly 4, elongated cylindrical brushes 5 and 6, and auxiliary brushes 7 and 8.

Buoying means, which, in the illustrative embodiment shown, are blocks or sheets of styrofoam 20, are connected to the outside frame 3, to cause the platform to float with the ways 2 above the water level.

In the device shown, the outside frame is in the form of a skeletal box 21 with a substantially horizontal top frame angle 22, outboard vertical rails 23, stanchions 25 and diagonal braces 26. The lower end of each of the diagonal braces 26 is preferably welded both to a vertical rail and to a superstructure connecting beam 30. The connecting beam 30, in this embodiment, is a box beam extending from one outboard edge of the outside frame to the opposite outboard edge of the outside frame, transversely of the platform. Sill beams 31, are welded or otherwise secured between the connecting beams 30, immediately below the stanchions 25, extending fore and aft of the platform.

The stanchions 25 are shown as being substantially square box shapes, and extend vertically, perpendicularly to the connecting beams 30 to which they are secured.

Figure 2:
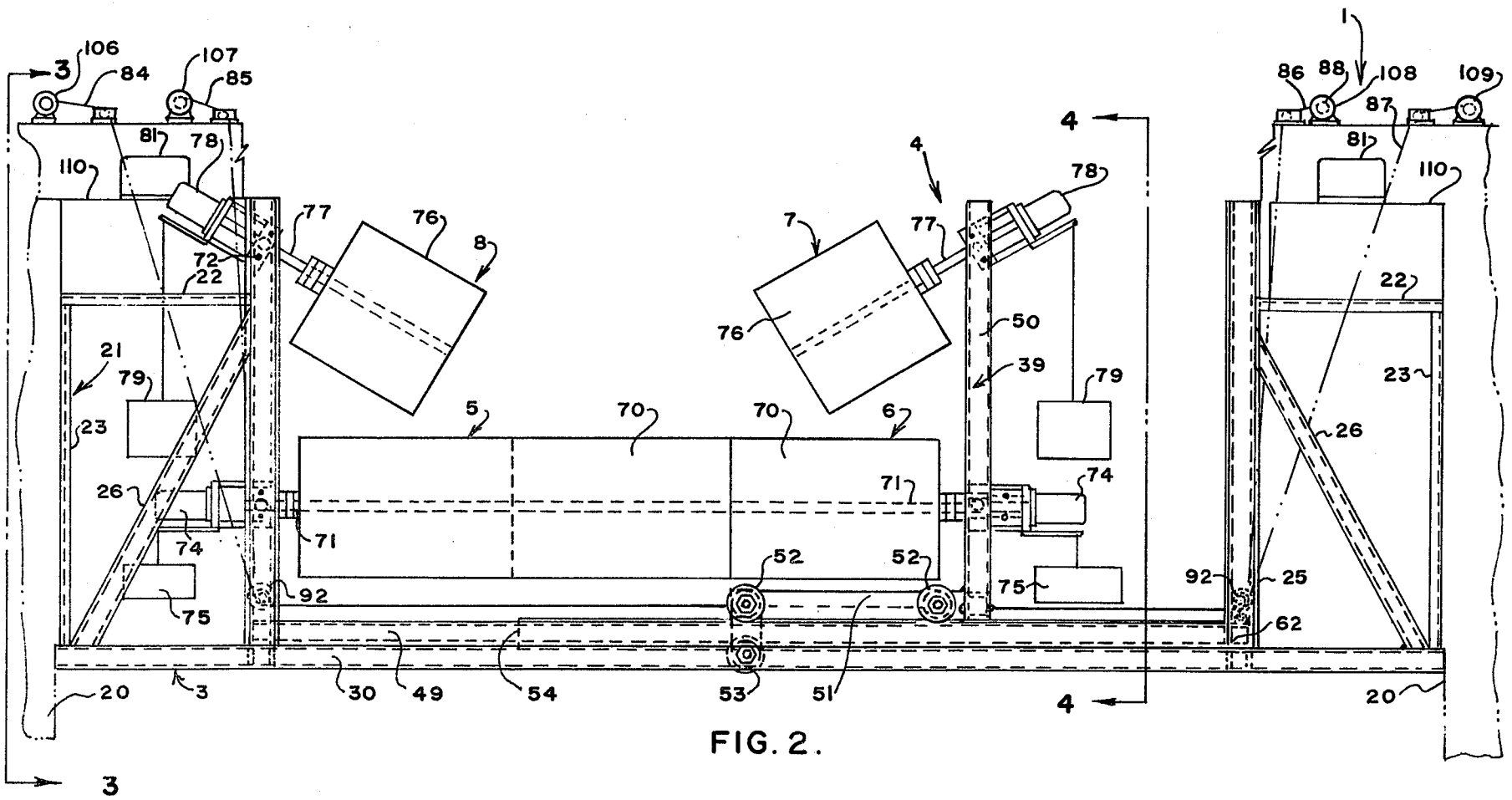
FIG. 2 is a view in side elevation of the device shown in FIG. 1.

The inside frame assembly 4 includes an inside frame mounted for vertical movement within the confines of the stanchions 25 and above the connecting beams 30 of the outside frame. In this embodiment, one of the members of the inside frame is a brush support 38, which as viewed in FIG. 2 is at the left side of the frame. At the right side of the frame is a sliding inside frame member 60, with an upper cross beam 61, a lower cross beam 62, guide angles 64, which also constitute vertical frame members, and suitable cross bracing to provide the necessary rigidity to the sliding inside frame 60. The inside frame assembly 4 also includes a second, traversing brush support 39.

Both of the brush supports 38 and 39 have an upper cross member 40, a sill beam 41, and vertical rails 42, 43, 44 and 45 extending between, secured to, and spaced along the sill beam 41 and upper cross member 40.

The brush support 38 also includes guide angles 46, which, like the guide angles 64 of the sliding inside frame member 60, have bearing plates 47 and 48 extending the full height of the brush support 38 and sliding frame member respectively.

Inside frame connecting beams 49 extend between the sill beam of the brush support 38 and the sill beam of the sliding inside frame member 60. Suitable gussets or other bracing can be used to add strength to the inside frame structure, but these are conventional and are omitted for clarity.

Figure 4:
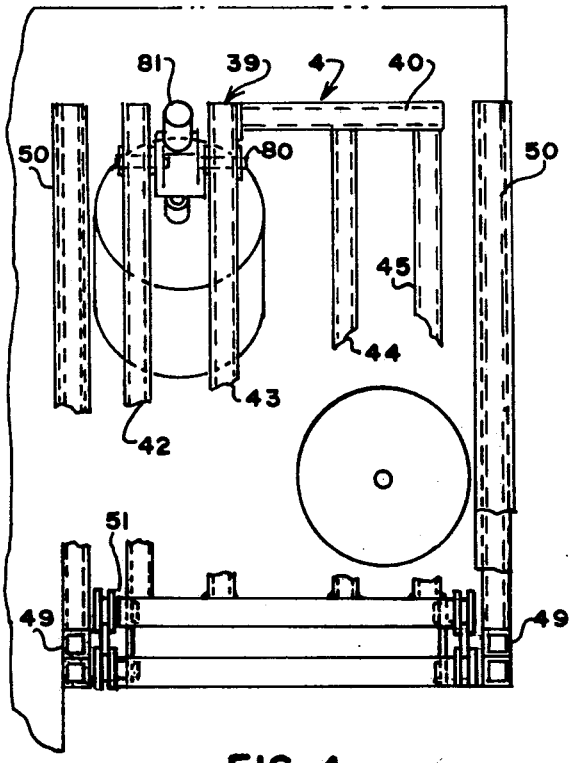
FIG. 4 is a sectional view taken along the line 4—4 of FIG. 2.

The traversing brush support 39 has posts 50 defining the outside vertical edges of the brush support. At the foot of the posts 50, the traversing brush support 39 has a carriage 51 secured to it. The carriage 51 extends parallel to the connecting beams 49, and inboard of them. The carriage 51 has revolvably mounted on stub axles projecting outboardly, upper wheels 52 and lower wheels 53. The upper wheels 52 ride on tracks 54 mounted on spacers 55 which are secured to an inside vertical face of connecting beam 49, as shown particularly in FIGS. 1 and 4. The wheels 54 are either in engagement with or closely adjacent the lower edge of the track, to prevent rocking of the carriage. The traversing brush support 39 is accordingly mounted for movement back and forth in a direction athwart the platform and ways.

In this embodiment, the scrubbing means to which the invention is addressed are the brushes 5 and 6. Each of the brushes 5 and 6 has bristles 70 mounted on and for rotation with a shaft 71. The shaft 71 is journalled in bearings trunion mounted between rails 44 and 45. In this embodiment, the shafts 71 are driven by hydraulic motors 74. In the drawings, counterweights 75 are shown as gravity biasing the brushes about a trunion 73. However, this is intended to be somewhat diagrammatic, as indicating any suitable biasing means, which may even take the form of buoyant bristles or a float secured at the end of the bristles most remote from the trunion, for example.

The auxiliary brushes 7 and 8 also include bristles 76, mounted for rotation by shaft 77 driven by a hydraulic motor 78. A counterweight 79, diagrammatically indicated in FIG. 2, serves to bias the brushes about a trunion 80 mounted between rails 42 and 43.

Figure 3:
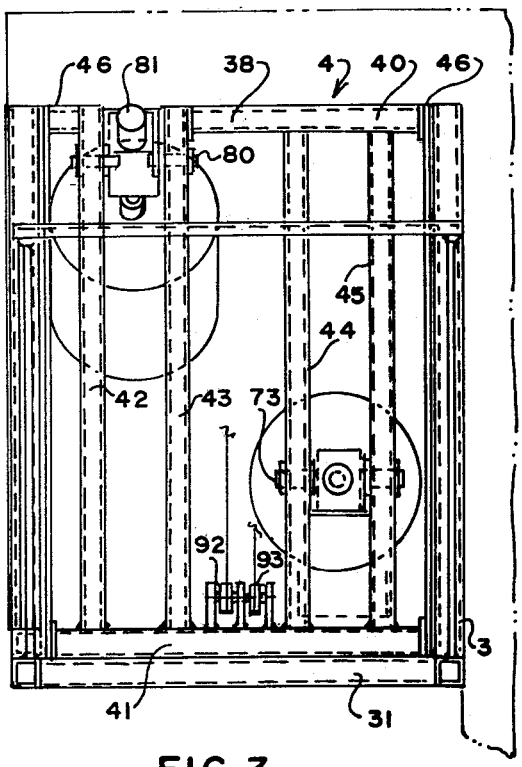
FIG. 3 is a sectional view taken along the line 3—3 of FIG. 2.

As shown particularly in FIG. 3, pulley blocks or sheaves 92 and 93 are mounted on a top surface of the sill beam 41 of the brush support 38. Similar sheaves are mounted on the sill beam or lower cross beam 62 of the sliding inside frame member. Sheaves 90 and 91 vertically aligned with sheaves 92 and 93 respectively are mounted on the ways 2.

Winches 106, 107, 108 and 109, driven by hydraulic motors, are mounted on the ways. A cable 84 is attached at one end to the drum of the winch 106, passes over the sheave 90, thence around the sheave 92, and is connected at its other end to a sill beam 41 of the brush support 39. A cable 87 is connected at one end to the winch 109, passes over a sheave 90 and around a sheave 92, and is connected to the other side of the sill beam 41 of the brush support 39.

A cable 85 is connected at one end to the winch 107, passes over the sheave 91, around the sheave 93, and is connected at its upper end to an outside frame cross bar between the upper ends of the diagonal braces 26. Similarly, a cable 86 is connected at one end to the winch 108, passes over the sheave 91 around the sheave 93 and is connected at its upper end to an outside frame cross bar between the upper ends of the diagonal braces 26.

A hydraulic pump 81 supplies hydraulic fluid, which it obtains from a hydraulic fluid tank 110, to the hydraulic motors for the winches and the hydraulic motors 74 and 78 which drive the brushes, through suitable piping and flexible conduit.

In the embodiment shown, a pusher sling 115, which consists, in its simplest form, of a cable, is, in the embodiment shown, operated by capstans 116.

In the operation of the device, the sling 115 can be brought around the stern of the vessel, and the vessel pushed to the place at which the bow is adjacent or immediately above the brushes 5 and 6. The inside frame may then be raised until the brushes are in the desired engagement with the bottom of the vessel. The brush support 39 is moved toward or away from the brush support 38 to accommodate the beam of the vessel, this being determined in the embodiment shown, by the bearing of the auxiliary brushes 7 and 8 on the hull. If the position of the auxiliary brushes 7 and 8 is disregarded, it can be seen that for cleaning in a single pass, if the brushes 5 and 6 are ten feet long, a vessel of any beam from one or two feet to twenty feet can be cleaned in one pass, from its center line to a point ten feet outboard of the center line. However, there is little practical limit to the length of the brushes 5 and 6, because, by the use of buoyant bristles or auxiliary floats, as described heretofore, the problem of supporting the brushes is not a difficult one, and by using hydraulic motors to drive them, an extremely high torque can be obtained.

Numerous variations in the construction of the device of this invention within the scope of the appended claims will occur to those skilled in the art in the light of the foregoing disclosure. Merely by way of example, the bearing plates of the guide angles 46 and 64 can be replaced by rollers or bearings, although the bearing plate construction has much to recommend it, in providing a long bearing surface, preventing cocking, and in providing a simple but effective guiding and stabilizing arrangement, kept free from binding by the slight constant movement which is likely to take place when the device is afloat, relative to the stanchions 25 on which they move. The plates do not require as much of an extension, if any, of the fixed frame post, as an arrangement of wheels is likely to require. It will be observed that in the embodiment shown there is no connecting superstructure, so that vessels can be pushed straight through the device. In the case of large vessels, the platform can be pulled through the length of the vessel, rather than having the vessel pushed through the length of the platform, the relative motion being the same. It will be seen that in the diagrammatic representation of the winch and sling system, in order to simplify the portrayal of the scrubbing mechanism, the capstans 116 are shown as being positioned on the entering side of the device. In fact, the capstans will preferably be positioned on the leaving side, so that the sling can push the vessel entirely past the scrubbing brushes.

Other means can be provided for moving the vessel and platform relative to one another. Such devices are suggested by some of the prior art patents to which reference has been made.

Other means for moving the carriage 51 back and forth, and for raising and lowering the inside frame can also be provided, such as a hydraulic piston, or a rack and pinion arrangement.

The scrubbing means are preferably of the revolving brush type but could be of the continuous belt variety such as is suggested by Laney, U.S. Pat. No. 3,709,184, but in any event, the scrubbing means of this invention are staggered, not aligned athwartships.

The buoying means by which the platform is supported can be any suitable means, including air tanks, although the foamed polystyrene blocks have many advantages.

The various beams, bars and posts can be differently constructed. Connecting beam 30, for example, can be a bar-joist type or other trussed member.

The auxiliary brushes can be of other types also, as a "sun flower" type in which the bristles are roughly parallel with the axis of the shaft rather than perpendicular to it. These variations are merely illustrative.

Having thus described the invention, what is claimed and desired to be secured by letters patent is:

1. In a marine vessel bottom cleaning device wherein a floating platform has spaced ways between which a vessel to be cleaned passes lengthwise thereof and scrubbing means are supported on said platform, the improvement comprising at least two elongate scrubbing means spaced from one another lengthwise of said ways, extending in a direction generally athwart said ways and toward one another and in at least one position overlapping one another along the lengthwise path of said vessel, and means for moving said scrubbing means relative to one another from said position at which they overlap one another along the lengthwise path of said vessel in a direction outboard of said vessel and away from one another, said moving means being selectively actuable to move said scrubbing means independent of the presence of a vessel between said ways, said platform comprising an outside frame and an inside frame, said inside frame comprising said moving means, being located between said ways and having a traversing scrubbing means support by which at least one of said elongate scrubbing means is carried, and means for moving said inside frame scrubbing means support transversely of the lengthwise path of the vessel to move said elongate scrubbing means toward and away from another elongate scrubbing means.

2. The improvement of claim 1 wherein the scrubbing means are rotating brushes the axes of rotation of which extend in a direction athwart the platform, and the moving means are constructed to move said brushes from said overlapping position to a position at which they do not overlap.

3. The improvement of claim 1 wherein bouyant means are attached to the said outside frame for keeping the platform afloat, and said inside frame traversing scrubbing means support is translatably mounted on said outside frame for movement transversely of said platform.

4. In a marine vessel bottom cleaning device wherein a floating platform has spaced ways between which a vessel to be cleaned passes lengthwise thereof and scrubbing means are supported on said platform, the improvement comprising at least two elongate scrubbing means spaced from one another lengthwise of said ways, extending in a direction generally athwart said ways and toward one another and in at least one position overlapping one another along the lengthwise path of said vessel, and means for moving said scrubbing means relative to one another from said position at which they overlap one another along the lengthwise path of said vessel in a direction outboard of said vessel and away from one another, said platform comprising an outside frame and an inside frame, said inside frame being located between upright members of the outside frame and having a scrubbing means support by which at least one of said elongate scrubbing means is carried; and means carried by said outside frame and selectively controllable independent the presence of a vessel for moving said inside frame scrubbing means support transversely of the lengthwise path of the vessel to move the elongate scrubbing means it carries toward and away from another elongate scrubbing means.

5. In a marine vessel bottom cleaning device wherein a floating platform has spaced ways between which a vessel to be cleaned passes lengthwise thereof and scrubbing means are supported on said platform, the improvement comprising at least two elongate scrubbing means spaced from one another lengthwise of said ways, extending in a direction generally athwart said ways and toward one another and in at least one position overlapping one another along the lengthwise path of said vessel, and means for moving said scrubbing means relative to one another from said position at which they overlap one another along the lengthwise path of said vessel in a direction outboard of said vessel and away from one another, said platform comprising an outside frame and an inside frame, said inside frame having a traversing scrubbing means support and means for moving said scrubbing means support transversely of the lengthwise path of the vessel, said outside frame including side members and underwater connection members, and said inside frame including a second scrubbing means support member mounted on a side member of said outside frame for movement heightwise thereof and against movement transversely of said platform, said traversing scrubbing means support being mounted on said outside frame for movement heightwise thereof as well as transversely thereof, driving means for driving said scrubbing means mounted on said first and second scrubbing means supports, and elevator means mounted on said outside frame and connected to said inside frame for moving said scrubbing means supports heightwise of said outside frame.

* * * * *